United States Patent [19]

Carroll

[11] Patent Number: 5,070,755

[45] Date of Patent: Dec. 10, 1991

[54] MAGNETICALLY MOUNTED MUSICAL DISPLAY ASSEMBLY

[76] Inventor: Bobby L. Carroll, P.O. Box 4618, Greenville, S.C. 29608

[21] Appl. No.: 493,414

[22] Filed: Mar. 14, 1990

[51] Int. Cl.[5] ..... G10H 1/34

[52] U.S. Cl. ..... 84/600; 84/644; 84/95.2; 84/477 R

[58] Field of Search ..... 84/600, 644, 91.1, 94.2, 84/95.1, 95.2, 477 R

[56] References Cited

U.S. PATENT DOCUMENTS 4,756,222 7/1988 Armato ..... 84/600

*Primary Examiner*—Stanley J. Witkowski

*Attorney, Agent, or Firm*—Bailey & Hardaway

[57] ABSTRACT

An ornamental pressure operated musical display assembly is illustrated wherein a pressure actuated electrical music box and the like is provided with a depressible indicia carrying member C extending thereacross on one side for actuating the music box and for displaying the indicia E with a magnet G extending across a portion of a bottom of the music box for mounting the assembly on a magnetic surface.

7 Claims, 2 Drawing Sheets

MAGNETICALLY MOUNTED MUSICAL DISPLAY ASSEMBLY

BACKGROUND OF THE INVENTION

Heretofore numerous ornamental magnets have been supplied largely as novelty items for various uses such as positioning papers and notes upon surfaces constructed of magnetic material such as refrigerator doors and the like. These magnets can be shaped and carry indicia such as painted designs simulating the bodies of animals and the like. Ornamental electrical music boxes have been provided wherein switch mechanisms are actuated in a variety of ways including pressure operated mechanisms for initiating playing the music or other audible material stored in the box or housing.

It is an important object of this invention to provide a musical display assembly including a pressure operated mechanism for initiating the operation of audible material and for the display of indicia wherein magnetic mounting means position the assembly on a magnetic surface.

Preferably, there is an association between the indicia and the pressure operated musical material.

SUMMARY OF THE INVENTION

It has been found that a pressure operated musical apparatus may be provided so as to mount indicia bearing material such as a decal upon a flexible cover which through the application of pressure actuates a music producing mechanism including a storage chip, battery and speaker while providing a magnet extended partially across a bottom portion for attaching the display assembly to a metal object such as refrigerator and the like without interference with transmission of sound from within the assembly. A partition serves to mount the chip and battery as well as a switch mechanism opposite the indicia carrying flexible cover. Where the cover is manually depressed it acts as a movable switch member completing the circuitry to actuate the music playing components which have the capability once play is initiated to continue until the programmed musical sequence is complete even though pressure upon the flexible cover is released.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an ornamental pressure operated musical display assembly wherein a housing A has an opening in a wall of the housing for aiding in transmitting sound from the housing. A speaker B is carried adjacent the opening in the housing. A pressure operated flexible housing cover C member extends across the housing. A partition D extends across a chip storing music, a battery and associated circuitry. Indicia E is carried by the cover on an outside surface thereof. A switch member F carried and supported by the partition initiates operation of the chip responsive to exerting pressure upon the indicia causing the cover to be depressed and to make contact with the switch and close the electrical circuit to actuate the components to initiate the music. A magnet G is carried by a bottom portion of the housing for mounting purposes. Thus, the assembly may be positioned upon any surface containing magnetic material with indicia displayed for easy access to initiate playing of music stored on the chip.

Figure 3:
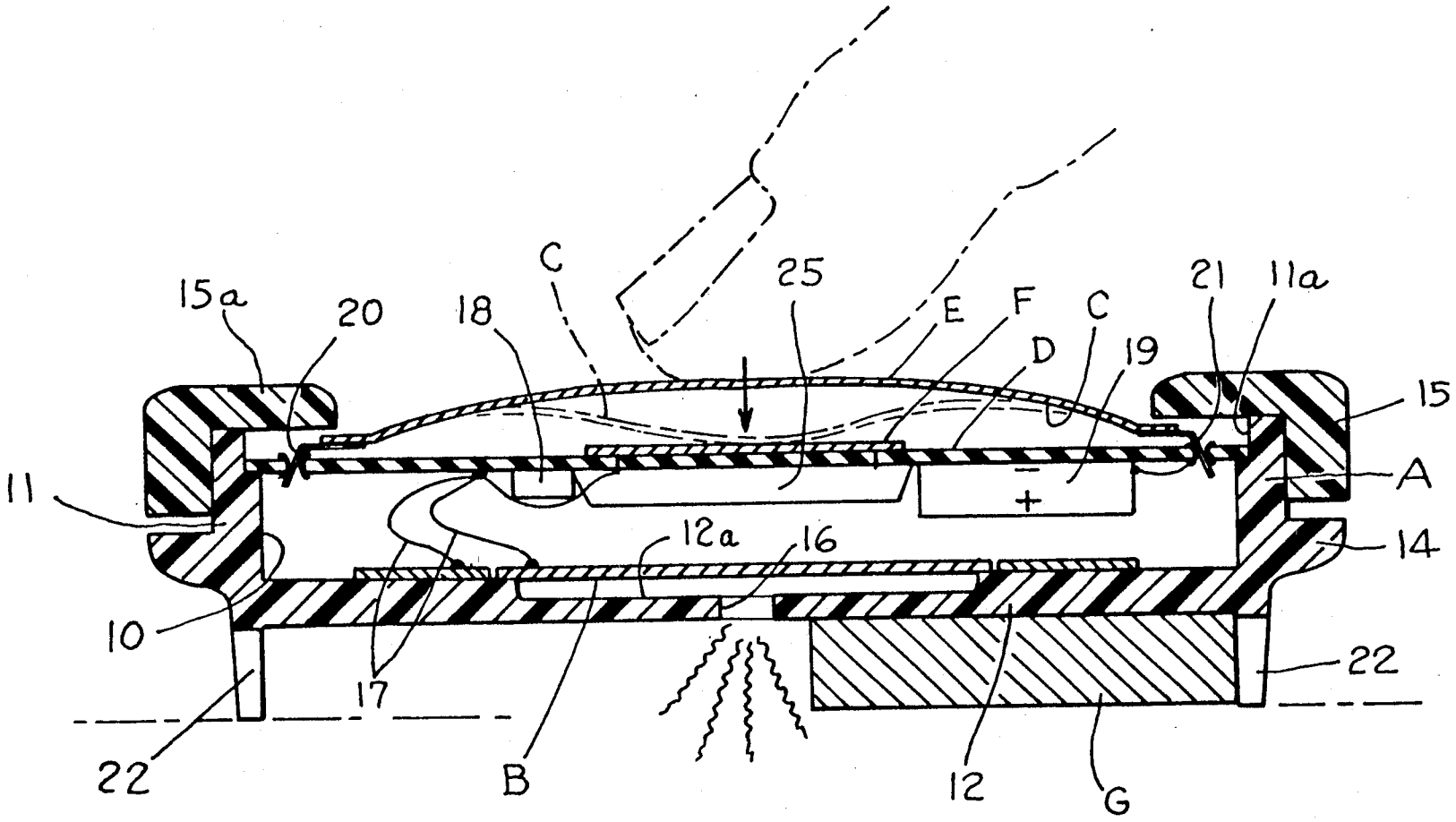
FIG. 3 is an enlarged transverse sectional elevation taken on the line 3—3 in FIG. 1 illustrating electrical components operated in response to pressure exerted upon the indicia carrying switching member and the arrangement for positioning the mounting magnet for carrying the display assembly upon a desired magnetic object.

The housing A is illustrated as having molded plastic inner walls 10 carried within an upstanding flange 11 integral with a base member 12. The flange 11 has a reduced upper portion defining an inner wall 11*a* while a reduced central portion 12*a* is carried within the bottom 12. The housing has flange 14 which carries a pressure fitted cover member 15 which includes an inwardly extending flange 15*a* which extends partially across and forms a part of the cover of the housing A. A speaker B is carried adjacent an opening 16 in the reduced lower portion 12*a* of the bottom 12 of the housing. The opening 16, as well as the portion 12*a* of reduced thickness, is provided to facilitate transmission of the sound from within the housing A. The speaker B has connection through suitable leads 17 to a chip 18 and power supply in the form of a battery 19 carried by the partition D. A switch member F is carried by the partition D and is operated by depressing a flexible housing cover C illustrated in the form of a metallic diaphragm removably connected to the partition D as at 20 and 21 for acting as circuitry closing the switch circuit initiating operation of the music reproducing apparatus for audibly reproducing the sounds carried by the chip 18 and emitting from the speaker and from within the housing. For this purpose, the diaphragm or flexible housing cover C is depressed to broken line position illustrated in FIG. 3. Once playing of the music has been initiated, the components automatically continue the program until the sequence is complete.

In order to further insure that the sounds will not be muffled and will be emitted without interference, spaced legs 22 are provided to position the housing in spaced relation upon the desired surface.

Figure 1:
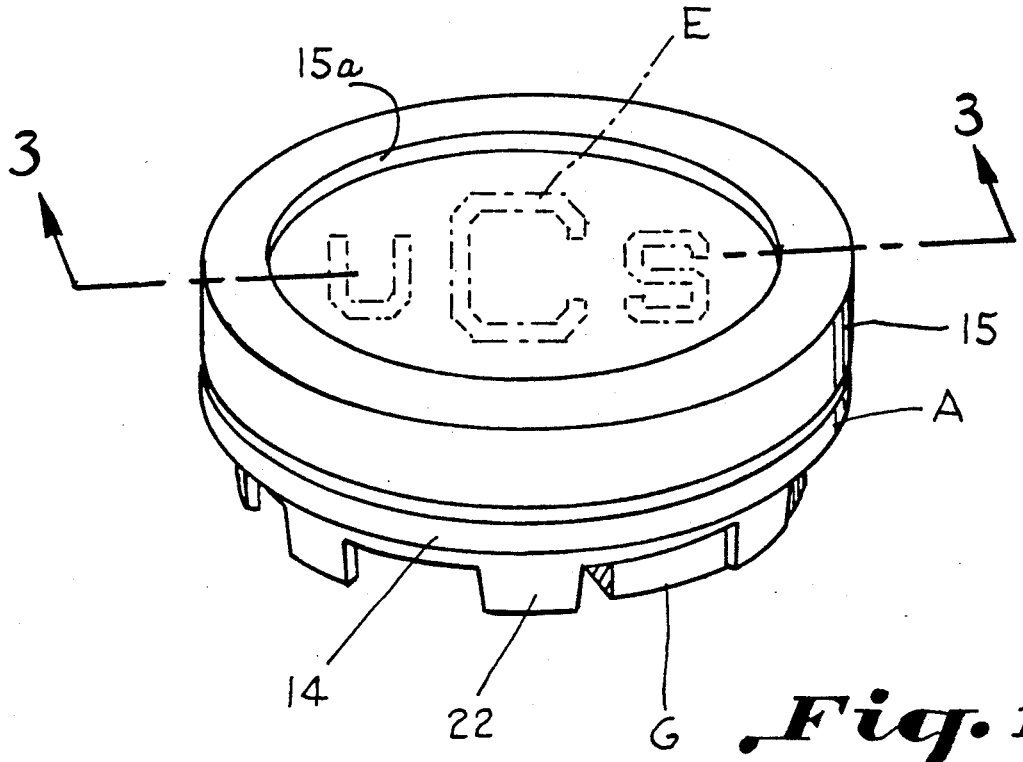
FIG. 1 is a perspective view illustrating an ornamental pressure operated musical display assembly constructed in accordance with the invention wherein the depressible cover displays indicia and initiates playing of the music.
Figure 2:
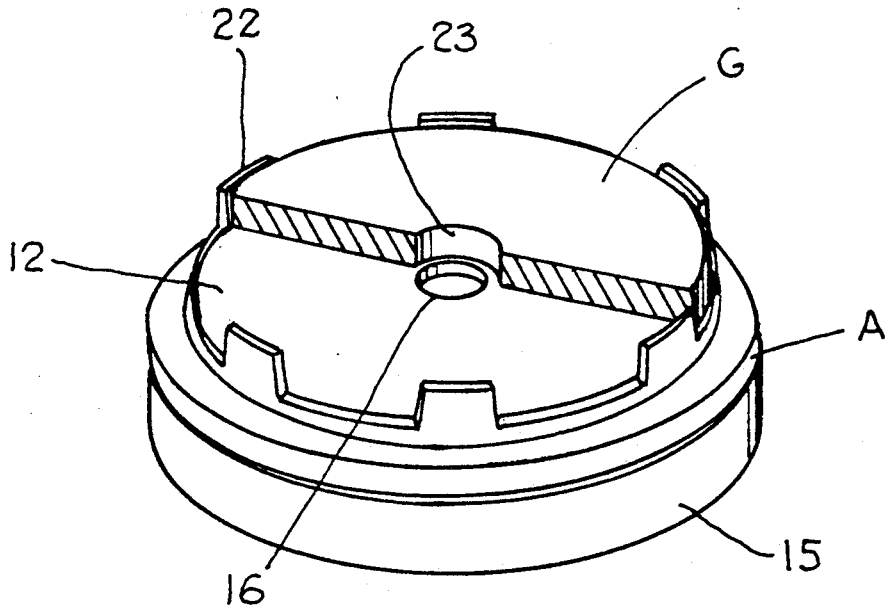
FIG. 2 is a perspective view looking toward the bottom of the assembly of FIG. 1 illustrating a mounting magnet constructed in accordance with the present invention constructed and positioned to facilitate sound transmission.

The magnet G is suitably secured preferably across approximately one-half of the lower surface of the housing as by glue (not shown) for causing the magnet to be affixed within the legs 22. A central cut out portion 23 is illustrated in FIG. 2 to assure that the opening 16 will not be obstructed so as to interfere with sound transmission during the playing of the music stored within the chip 18.

It will be noted that the various electrical components are carried by the partition D and that suitable electrical circuitry such as illustrated at 25 have connection with the various components as described above and may also be carried by the partition.

It will be further observed that the cover 15 and the flange 15*a* extend across the indicia carrying member such as decal E mounted upon the flexible cover C so as to form a frame therefor and secure together the various components of the assembly.

It is thus seen that a novelty musical display assembly has been provided which is capable of displaying through magnetic positioning any suitable indicia bearing material which also serves as an actuating mechanism for music reproducing material stored within the assembly. While the device is intended to be ornamental and the audio material supplied in the form of music, it is apparent that any display and ornamental material including letters and numbers may be utilized with any form of audible material including spoken words within the scope of the invention.

While a preferred embodiment of the invention has been described using specific terms, such description is for illustrative purposes only, and it is to be understood that changes and variations may be made without departing from the spirit or scope of the following claims.

What is claimed is:

1. A pressure operated musical display assembly comprising:

a housing having an opening in a wall of the housing;

a speaker carried adjacent said opening in said housing;

a pressure operated cover member extending across said housing;

a partition extending across a chip storing music, a battery and associated circuitry contained in said housing;

indicia carried by said pressure operated cover on an outside surface thereof;

a switch member initiating operation of said chip responsive to contact by said cover resulting from exerting pressure thereupon; and a magnet carried by a bottom portion of said housing;

whereby said assembly may be positioned upon any surface containing magnetic material with the indicia displayed for easy access to initiate playing of music stored on said chip.

2. The structure set forth in claim 1 wherein said chip, battery, circuitry and switch member are carried by and mounted upon said partition.

3. The structure set forth in claim 1 including a rigid cover extending partially across said pressure operated cover member serving as a frame for said indicia and to maintain the components in assembled relation.

4. The structure set forth in claim 1 wherein said magnet extends across about one-half of a bottom of said housing opposite said speaker without obstructing said opening.

5. The structure set forth in claim including spaced feet projecting about said bottom to position said housing upon said surface and to assure adequate sound transmission.

6. The structure set forth in claim 1 wherein said indicia is carried by a decal and the like having a common theme with said music.

7. The structure set forth in claim 1 wherein said flexible cover is a metallic diaphragm serving as a part of the circuitry for the switch member.

* * * * *